US008018155B2

(12) United States Patent
Hasegawa et al.

(10) Patent No.: US 8,018,155 B2
(45) Date of Patent: Sep. 13, 2011

(54) SHORT ARC TYPE HIGH VOLTAGE ELECTRICAL DISCHARGE ELECTRODE, SHORT ARC TYPE HIGH VOLTAGE ELECTRICAL DISCHARGE TUBE, SHORT ARC TYPE HIGH VOLTAGE ELECTRICAL DISCHARGE LIGHT SOURCE APPARATUS, AND THEIR MANUFACTURING METHODS

(75) Inventors: Yoji Hasegawa, Shizuoka (JP); Takeshi Kodama, Kanagawa (JP); Kenichi Matsuura, Kanagawa (JP); Makoto Furukawa, Fukushima (JP)

(73) Assignee: Sony Corporation (JP)

( * ) Notice: Subject to any disclaimer, the term of this patent is extended or adjusted under 35 U.S.C. 154(b) by 1074 days.

(21) Appl. No.: 11/514,740

(22) Filed: Aug. 31, 2006

(65) Prior Publication Data

US 2007/0108911 A1 May 17, 2007

(30) Foreign Application Priority Data

Sep. 2, 2005 (JP) ..... P2005-255571
Jul. 20, 2006 (JP) ..... P2006-198639

(51) Int. Cl.
*H01J 17/04* (2006.01)

(52) U.S. Cl. ..... 313/631; 313/633

(58) Field of Classification Search ..... 313/567–580, 313/627–633
See application file for complete search history.

(56) References Cited

U.S. PATENT DOCUMENTS 3,911,309 A * 10/1975 Kummel et al. ..... 313/346 R
5,828,185 A * 10/1998 Fellows et al. ..... 315/246
2003/0201719 A1 * 10/2003 Ikeuchi et al. ..... 313/631

FOREIGN PATENT DOCUMENTS

WO 98/27575 6/1998

* cited by examiner

*Primary Examiner* — Anne M Hines
(74) *Attorney, Agent, or Firm* — Lerner, David, Littenberg, Krumholz & Mentlik, LLP

(57) ABSTRACT

A short arc type high voltage electrical discharge electrode includes an electrode center spindle made from a refractory metal and having a tip; and an electrode main body made from a refractory metal and disposed at the tip of the electrode center spindle. The electrode center spindle is subjected to final sintering, the electrode main body is subjected to temporary sintering, and the final-sintered electrode center spindle is inserted into a center hole of the temporary-sintered electrode main body so as to form combination which is sintered together.

9 Claims, 9 Drawing Sheets

SINTERING TEMPERATURE AND RETAINING TIME

SHORT ARC TYPE HIGH VOLTAGE ELECTRICAL DISCHARGE ELECTRODE, SHORT ARC TYPE HIGH VOLTAGE ELECTRICAL DISCHARGE TUBE, SHORT ARC TYPE HIGH VOLTAGE ELECTRICAL DISCHARGE LIGHT SOURCE APPARATUS, AND THEIR MANUFACTURING METHODS

CROSS-REFERENCE TO RELATED APPLICATIONS

The present application claims priority from Japanese Patent Application Nos. 2005-255571 filed on Sep. 2, 2005 and 2006-198639 filed on Jul. 30, 2006, the disclosures of which are hereby incorporated by reference herein.

BACKGROUND OF THE INVENTION

1. Field of the Invention

The present invention relates to a short arc type high voltage electrical discharge electrode, a short arc type high voltage electrical discharge tube, a short arc type high voltage electrical discharge light source apparatus, and their manufacturing methods.

2. Description of Related Art

A high intensity electrical discharge (HID) lamp such as a metal halide lamp, an extra-high voltage mercury lamp and the like are widely used for the light source of a projection type projector such as a liquid crystal projector and the like, and a lighting lamp for a car.

At least a part of an electrical discharge electrode of a metal halide lamp, an extra-high voltage mercury lamp and the like becomes a high temperature, reaching 2000° C. or more during the operation of the electrical discharge electrode.

For this reason, the electrical discharge electrode is usually made of a refractory metal such as tungsten.

As the electrode characteristics required for an electrical discharge lamp, geometry accuracy, the reliability of strength in a high temperature and the like can be cited.

For example, in the metal halide lamp used as a light source of a display device such as a liquid crystal projector TV and the like, and in a light source lamp using a short arc type high voltage electrical discharge tube such as the extra-high voltage mercury lamp and the like, electrical discharge stability as a point light source is especially important.

In this case, changes of an arc spot and the differences of an arc temperature are not preferable because they cause a flicker and the dispersion of lamp luminance.

FIG. 12 is a schematic sectional view of a short arc type high voltage electrical discharge tube in an extra-high voltage mercury lamp, a metal halide lamp and the like.

The electrical discharge tube 100 is composed of a pair of electrical discharge electrodes 103 disposed in an electrical discharge tube body 102 including a sealed hollow 101 at the center thereof. The pair of electrical discharge electrodes 103 is arranged so that their electrical discharge tips may be opposed to each other with a predetermined interval held between them in the sealed hollow 101. Power supply terminals 104 from both the electrodes 103 are airtightly sealed to be derived from both the ends of the electrical discharge tube body 102 onto the outside.

FIG. 13 is a side view of a general electrical discharge electrode 103 of related art. The electrical discharge electrode 103 is composed of an electrode main body 105, which is used as the electrode tip to cause an electrical discharge substantially and is attached to the tip of an electrode center spindle 106 used as an electrification conductor and a mechanical supporter.

FIGS. 14A and 14B are side views of a main body member 105*a* and a center spindle member 106*a* constituting the electrode main body 105 and the electrode center spindle 106 of the electrical discharge electrode 103, respectively.

The main body member 105*a* is made into the shape of a coil of two layers of the form which enlarges the surface area thereof in order to heighten the heat radiation effect of a wire rod including a refractory metal such as tungsten and the like as the principal component, for example.

Moreover, the center spindle member 106*a* is formed in a cylinder similarly.

The tip portion of the center spindle member 106*a* is pierced into the center hole of the coil-shaped main body member 105*a*, and the center spindle member 106*a* and the main body member 105*a* at the tip portion are melted by the irradiation of a YAG laser light or the like to form the short arc type high voltage electrical discharge electrode 103 in the shape of a hanging bell having a spherical surface smoothly curved at the tip portion as shown in FIG. 13.

However, this manufacturing method and the structure cannot perform one point irradiation of the laser light because a laser irradiation unit necessary at the time of the melting with the YAG laser has a depth and an extent. Consequently, the focus of the irradiated laser light is easily shifted at each part, and the irradiation power becomes uneven. Thereby, the electrode temperature at the time of electrical discharge operation is dispersed, and changes of the arc spot and the unevenness of the arc temperature arise. Consequently, the optical characteristics of the short arc type high voltage electrical discharge tube composed of the electrical discharge electrodes are dispersed to cause the lowering of the yield.

On the other hand, a proposal of a sintered electrode was made (see Published Japanese Translation of a PCT Application No. 2000-505939). A rod core pin corresponding to the electrode center spindle 106 mentioned above is prepared as the sintered electrode, and the sintered electrode is formed by compressing powder constituting the sintered electrode around the rod core pin and by sintering the powder to be combined with the rod core pin. Thereby the sintered electrode is formed. Alternatively, the sintered electrode is formed by the following steps of: arranging the rod core pin in a compression type mold; injecting a mixture constituting an electrode into the periphery of the rod core pin; and sintering the mixture to combine with the rod core pin.

However, in the case of such a configuration, because a material containing a binder therein is compressed together with the metal powder constituting the sintered electrode around the rod core pin at the time of sintering, the rod core pin is subjected to high temperature processing in the state in which the rod core pin touches the binder. In this case, the embrittlement of the rod core pin by recrystallization of the impurities in the binder is promoted.

Moreover, because the electrode in the state of not being sintered is sintered, the shrinkage ratios of the sintered electrode and the rod core pin are greatly different from each other. For this reason, breakage arises, or an electrical discharge electrode in which distortion remains is constituted.

Owing to such embrittlement, the existence of distortion, and the like, there is the possibility that the rejection rate becomes high, that the uniformity of characteristics is inferior, and that the problems of the durability and the reliability of a heat cycle of high temperature heating at the time of operation and fall of temperature at the time of non-operating arise.

Moreover, it is possible to press the electrode center spindle into the center hole formed in the electrode main body in order to aim at settling the problems mentioned above. But, because the sintered body of tungsten is poor in elasticity, the pressing method cannot be applied to the sintered body.

On the other hand, in a short arc type high voltage electrical discharge electrode, an electrical discharge tube, an electrical discharge light source apparatus and the like, it is desired to further improve luminous efficiency for the further improvement in the reliability of a luminance.

In passing, a metal halide lamp, an extra-high voltage mercury lamp and the like in related art are severally mounted with an electrode similar to the general electrical discharge electrode 103 (see FIG. 13). For example, in order to heighten luminous efficiency, there is generally a method of raising a luminous metal vapor pressure by raising injection power to raise the temperature of the inner wall of an electrical discharge tube. However, a temperature rise of the electrode mainly by ion impact is caused, and it becomes an issue of shortening of life caused by the consumption of the electrode owing to heat and the promotion of the crystallization (the so-called devitrification) of the inner wall of a quartz tube. There is means for thickening the diameter of the electrode center spindle as a measure of the issue. But, if the diameter of the electrode center spindle is thickened, the danger of resulting in an explosion increases owing to the generation of distortion of quartz ($SiO_2$) caused by the difference of the coefficients of thermal expansion between the tungsten W (including tungsten as the principal component) and the quartz of the electrode material at the quartz tube sealing portion.

The inventors of the present invention found that the electrical discharge electrode of related art shown in FIGS. 13, 14A and 14B was bad in the heat conduction from the tip of the electrode main body 105 to the electrical discharge tube body (e.g. a quartz tube body) 102 through the electrode center spindle 106 at the time of the operation of the electrical discharge tube to make it impossible to raise the inner wall temperature of the tube body efficiently, and consequently that the luminous efficiency thereof did not rise, because the electrode main body 105 and the electrode center spindle 106 were connected to each other with voids in a part as shown in the sectional view of FIG. 15.

It is desirable to provide a short arc type high voltage electrical discharge electrode, a short arc type high voltage electrical discharge tube, and/or a short arc type high voltage electrical discharge light source apparatus, each having the stability and the uniformity of characteristics and being excellent in durability and reliability even in the case of adopting an electrode configuration including tungsten as the principal component, and a manufacturing method of each of them.

SUMMARY OF THE INVENTION

A short arc type high voltage electrical discharge electrode according to an embodiment of the present invention includes an electrode center spindle made from a refractory metal and having a tip; and an electrode main body disposed at the tip of the electrode center spindle, the electrode main body being made from a refractory metal. The electrode center spindle is subjected to final sintering, the electrode main body is subjected to temporary sintering, and the final-sintered electrode center spindle is inserted into a center hole of the temporary-sintered electrode main body so as to form a combination which is sintered together.

In the short arc type high voltage electrical discharge electrode mentioned above according to the embodiment of the present invention, each of the electrode main body and the electrode center is made of a refractory metal containing tungsten as a principal component.

A short arc type high voltage electrical discharge electrode according to an embodiment of the present invention includes an electrode center spindle made of a sintered body of a refractory metal and having a tip; and an electrode main body disposed at the tip of the electrode center spindle, the electrode main body being made of a sintered body of a refractory metal, wherein a contact area between the electrode main body and the electrode center spindle is within a range of from 0.9 $mm^2$ to 3.2 $mm^2$.

A manufacturing method of a short arc type high voltage electrical discharge electrode according to an embodiment of the present invention is a manufacturing method of a short arc type high voltage electrical discharge electrode including an electrode main body disposed at a tip portion of an electrode center spindle. The method includes preparing the electrode center spindle from a refractory metal and subjecting the electrode center spindle to final sintering; molding the electrode main body from a refractory metal powder, the molded electrode main body having a center hole; subjecting the molded electrode main body to temporary sintering, the electrode main body after the temporary sintering having a void content higher than a void content of the electrode center spindle after final sintering; forming an electrical discharge electrode structure by inserting the tip portion of the electrode center spindle into the center hole of the electrode main body after the temporary sintering; and performing heat treatment on the electrical discharge electrode structure to finally sinter the electrode main body and combine the electrode main body and the electrode center spindle.

In the present embodiment, the electrode center spindle made from the refractory metal and having been subjected to the final sintering means one subjected to a wire drawing treatment after powder metallurgy of the refractory metal, or one sintered after manufacturing a molded body of a rod by a powder injection molding method or a powder molding method using a powder pressing method.

In the manufacturing method of the short arc type high voltage electrical discharge electrode of the present embodiment mentioned above, the electrode center spindle after the final sintering has a void content of 10% or less.

Moreover, in the manufacturing method of the short arc type high voltage electrical discharge electrode of the present embodiment mentioned above, the electrode main body after the heat treatment has a void content of 10% or less.

Moreover, in the manufacturing method of the short arc type high voltage electrical discharge electrode of the present embodiment mentioned above, the refractory metal powder is tungsten or tungsten containing an additive of 5 wt % or less, the refractory metal powder having an average particle diameter in a range of from 1 μm to 10 μm.

Moreover, in the manufacturing method of the short arc type high voltage electrical discharge electrode mentioned above of the present embodiment, the step of molding the electrode main body includes molding the electrode main body by a powder injection molding method or a powder pressing method.

A short arc type high voltage electrical discharge tube according to an embodiment of the present invention includes a tube body; a pair of electrical discharge electrodes enclosed in the tube body with a predetermined space between the electrodes; each of the electrical discharge electrodes including an electrode center spindle made from a refractory metal and having a tip, and an electrode main body disposed at the tip of the electrode center spindle, the electrode main body being made from a refractory metal. The electrode center spindle is subjected to final sintering, the electrode main body is subjected to temporary sintering, and the final-sintered electrode center spindle is inserted into a center hole of the temporary-sintered electrode main body so as to form a combination which is sintered together.

A short arc type high voltage electrical discharge tube according to an embodiment of the present invention includes a tube body; a pair of electrical discharge electrodes enclosed in the tube body with a predetermined space between the electrodes; each of the electrical discharge electrodes including an electrode center spindle made of a sintered body of a refractory metal and having a tip, and an electrode main body disposed at the tip of the electrode center spindle, the electrode main body being made of a sintered body of a refractory metal, wherein a contact area between the electrode main body and the electrode center spindle is within a range of from 0.9 $mm^2$ to 3.2 $mm^2$.

A manufacturing method of a short arc type high voltage tube according to an embodiment of the present invention is a manufacturing method of a short arc type high voltage electrical discharge tube including a pair of short arc type high voltage electrical discharge electrodes, each electrode having an electrode main body disposed at a tip portion of an electrode center spindle, the electrical discharge electrodes being disposed in an electrical discharge tube body with a predetermined space between the electrodes, the method including preparing the electrode center spindle from a refractory metal and subjecting the electrode center spindle to final sintering; molding the electrode main body from a refractory metal powder, the molded electrode main body having a center hole; subjecting the molded electrode main body to temporary sintering, the electrode main body after the temporary sintering having a void content higher than a void content of the electrode center spindle after final sintering; forming an electrical discharge electrode structure by inserting the tip portion of the electrode center spindle into the center hole of the electrode main body after the temporary sintering; and performing heat treatment on the electrical discharge electrode structure to finally sinter the electrode main body and combine the electrode main body and the electrode center spindle.

The method further includes the step of assembling the electrical discharge electrodes in the electrical discharge tube body after the heat treatment step.

A short arc type high voltage electrical discharge light source apparatus according to an embodiment of the present invention includes a short arc type high voltage electrical discharge tube including a pair of electrical discharge electrodes enclosed in a tube body with a predetermined space between the electrodes; and a reflector radiating light emitted from the short arc type high voltage electrical discharge tube in a predetermined direction; each of the electrical discharge electrodes including an electrode center spindle made from a refractory metal and having a tip, and an electrode main body disposed at the tip of the electrode center spindle, the electrode main body being made from a refractory metal.

Furthermore, the electrode center spindle is subjected to final sintering, the electrode main body is subjected to temporary sintering, and the final-sintered electrode center spindle is inserted into a center hole of the temporary-sintered electrode main body so as to form a combination which is sintered together.

A short arc type high voltage electrical discharge light source apparatus according to an embodiment of the present invention includes a short arc type high voltage electrical discharge tube including a pair of electrical discharge electrodes enclosed in a tube body with a predetermined space between the electrodes; and a reflector radiating light emitted from the short arc type high voltage electrical discharge tube in a predetermined direction; each of the electrical discharge electrodes including an electrode center spindle made of a sintered body of a refractory metal and having a tip, and an electrode main body disposed at the tip of the electrode center spindle, the electrode main body being made of a sintered body of a refractory metal; wherein a contact area between the electrode main body and the electrode center spindle is within a range of from 0.9 $mm^2$ to 3.2 $mm^2$.

A manufacturing method of a short arc type high voltage electrical discharge light source apparatus according to an embodiment of the present invention is a manufacturing method of a short arc type high voltage electrical discharge light source apparatus including a short arc type high voltage electrical discharge tube having a pair of short arc type high voltage electrical discharge electrodes disposed in an electrical discharge tube body and a reflector radiating an emitted light from the short arc type high voltage electrical discharge tube in a predetermined direction, each electrode having an electrode main body disposed at a tip of an electrode center spindle, the method including preparing the electrode center spindle from a refractory metal and subjecting the electrode center spindle to final sintering; molding the electrode main body from a refractory metal powder, the molded electrode main body having a center hole; subjecting the molded electrode main body to temporary sintering, the electrode main body after the temporary sintering having a void content higher than a void content of the electrode center spindle after final sintering; forming an electrical discharge electrode structure by inserting the tip portion of the electrode center spindle into the center hole of the electrode main body after the temporary sintering; and performing heat treatment on the electrical discharge electrode structure to finally sinter the electrode main body and combine the electrode main body and the electrode center spindle.

The method further includes the step of assembling the electrical discharge electrodes in the electrical discharge tube body after the heat treatment step to form the short arc type high voltage electrical discharge tube; and arranging the short arc type high voltage electrical discharge tube at a position having a predetermined relationship to the reflector.

Moreover, in the manufacturing method of the short arc type high voltage electrical discharge tube according to the present embodiment and the manufacturing method of the short arc type high voltage electrical discharge light source apparatus according to the present embodiment, at least a part of the heat treatment step is performed by heat generation caused by an electrical discharge between the pair of electrical discharge electrodes after the assembly of the electrical discharge electrodes in the electrical discharge tube.

The short arc type high voltage electrical discharge electrode according to the embodiment of the present invention has a configuration in which the electrode main body is disposed at the tip portion of the electrode center spindle, i.e., on the side of the tip from which an electrical discharge is generated, and the electrification path to the electrode main body is configured by the electrode center spindle. Thereby, the short arc type high voltage electrical discharge electrode is configured so that the electrode main body is supported by the electrode center spindle. In the configuration, because the short arc type high voltage electrical discharge electrode of the present invention is configured so that the electrode main body having been subjected to temporary sintering, i.e., the electrode main body in which the binder has been substantially removed by the temporary sintering, and the electrode center spindle having been sintered are combined by sintering, the embrittlement of the electrode center spindle caused by the binder, which has been described above, can be avoided.

Moreover, because the short arc type high voltage electrical discharge electrode has the sintering combination structure of the temporarily sintered electrode main body and the electrode center spindle, the shrinkage ratios of the sintering combination of both the temporarily sintered electrode main body and the electrode center spindle are brought to be close to each other by a predetermined degree. Consequently, the short arc type high voltage electrical discharge electrode has a configuration in which it is difficult to produce distortion, cracks and the like.

The short arc type high voltage electrical discharge tube and the short arc type high voltage light source apparatus, each of which is formed by applying the short arc type high voltage electrical discharge electrode, have uniform characteristics, and can achieve an improvement in their durability and their reliability.

The manufacturing method of the short arc type high voltage electrical discharge electrode according to the embodiment forms the electrode main body by forming a molded body, concretely by the powder injection method or by the powder pressing method. On the other hand, the manufacturing method configures the electrode center spindle which has been sufficiently sintered, and the method is made to be one performing the sintering combination of the electrode main body and the electrode center spindle. Consequently, the difference of the shrinkage ratios at the time of sintering the combination can be made to be sufficiently small, while the necessary degree of the difference is made to remain. Thereby, the generation of distortion and cracks owing to a large difference between the shrinkage ratios can be avoided.

Simultaneously, by the difference of predetermined shrinkage ratios, the sintering combination can be performed while the electrode center spindle is pressed hard by the electrode main body.

Consequently, it is possible to manufacture a short arc type high voltage electrical discharge electrode having improved yield and uniform properties, and high durability and high reliability.

Consequently, the manufacturing method of the short arc type high voltage electrical discharge tube according to the embodiment and the manufacturing method of the short arc type high voltage electrical discharge light source apparatus according to the embodiment, which electrical discharge tube and which light source apparatus have been formed by applying the manufacturing method of the short arc type high voltage electrical discharge electrode, can manufacture a short arc type high voltage electrical discharge tube which has high reliability, stable characteristics and excellent durability.

In the short arc type high voltage electrical discharge electrode according to the present embodiment, the contact area between the electrode main body and the electrode center spindle is within a range of from 0.9 $mm^2$ to 3.2 $mm^2$. Thereby, in case the present invention is applied to an electrical discharge tube or a light source apparatus, the thermal conductivity from the tip of the electrode main body to the inner wall of the electrical discharge space of the electrical discharge tube body via the electrode center spindle becomes large, and consequently the temperature of the inner wall of the electrical discharge tube can be efficiently raised. Thereby, the luminous efficiency is more improved. Consequently, further improvement of the luminance reliability can be achieved.

By applying the short arc type high voltage electrical discharge electrode in which the contact area between the electrode main body and the electrode center spindle is within a range of from 0.9 $mm^2$ to 3.2 $mm^2$ to the short arc type high voltage electrical discharge tube according to the present invention and to the short arc type high voltage light source apparatus according to the present invention, the luminous efficiency is more improved, and further improvement of the luminance reliability can be achieved.

DETAILED DESCRIPTION

In the following, the embodiments of the present invention are described with reference to the attached drawings.

The manufacturing method of each of a short arc type high voltage electrical discharge electrode, a short arc type high voltage electrical discharge tube and a short arc type high voltage electrical discharge light source apparatus according to the present invention, and the embodiments of the short arc type high voltage electrical discharge electrode are described. However, it is needless to say that the present invention is not limited to the embodiments.

Embodiment of Short Arc Type High Voltage Electrical Discharge Electrode

Figure 1A:
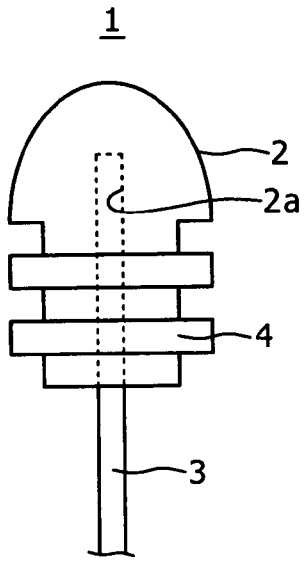
FIGS. 1A and 1B are a schematic side view and a schematic sectional view, respectively, showing an example of a short arc type high voltage electrical discharge electrode according to an embodiment of the present invention.
Figure 1B:
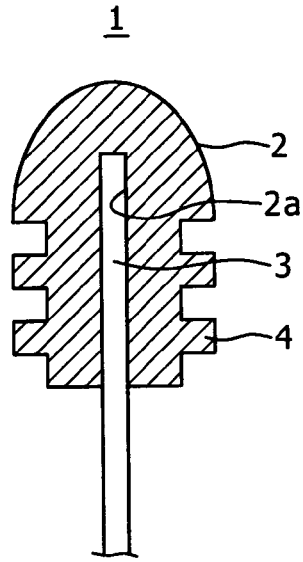

FIGS. 1A and 1B are a schematic side view and a schematic sectional view, respectively, of a short arc type high voltage electrical discharge electrode 1 according to an embodiment of the present invention.

The short arc type high voltage electrical discharge electrode 1 has a configuration in which the tip portion of a rod-shaped electrode center spindle 3 is inserted into a center hole 2*h* of a temporarily sintered electrode main body 2, each made of a refractory metal, so that the electrode main body 2 and the electrode center spindle 3 may be sintered to be combined with each other.

It is desirable to make the electrode main body 2 and the electrode center spindle 3 have the same composition. It is possible to configure them to contain tungsten as the principal component and, for example, to add the so-called dopant such as kalium (K), rhenium (Re) or the like as an embrittlement measure to tungsten (W) for the improvement of the embrittlement within 5%.

The tip of the electrode main body 2 smoothly curves in a convex such as a spherical surface, an ellipsoid, a paraboloid or the like, and is formed to be, for example, a hanging bell, which is rotational symmetry to the axial center of the electrode main body 2, i.e. the axial center of the center hole 2*a*.

Radiator fins 4, which annularly project around the axial center of the electrode main body 2, are molded on the circumferential surface of the electrode main body 2 in one body.

Figure 2A:
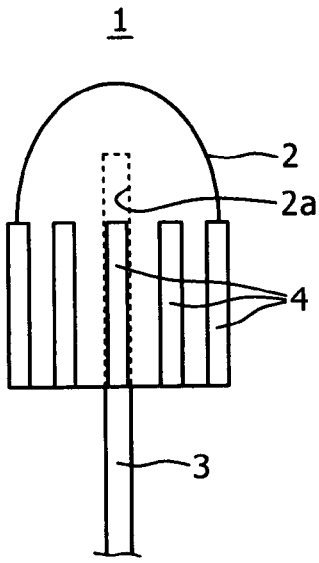
FIGS. 2A and 2B are a schematic side view and a schematic sectional view, respectively, showing another example of the short arc type high voltage electrical discharge electrode 1 according to an embodiment of the present invention.
Figure 2B:
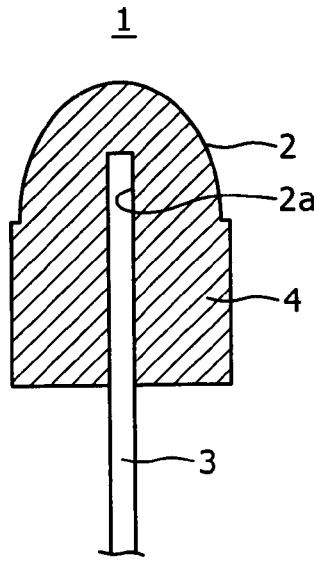

FIGS. 2A and 2B are a schematic side view and a schematic sectional view showing another embodiment of the short arc type high voltage electrical discharge electrode 1 according to the present invention. In this embodiment, the radiator fins 4 made to project so that they may extend along the direction of the axis on the circumferential surface of the electrode main body 2 are molded in one body. In FIGS. 2A and 2B, the portions corresponding to those in FIG. 1 are denoted by the same marks, and their duplicated descriptions are omitted.

Figure 3:
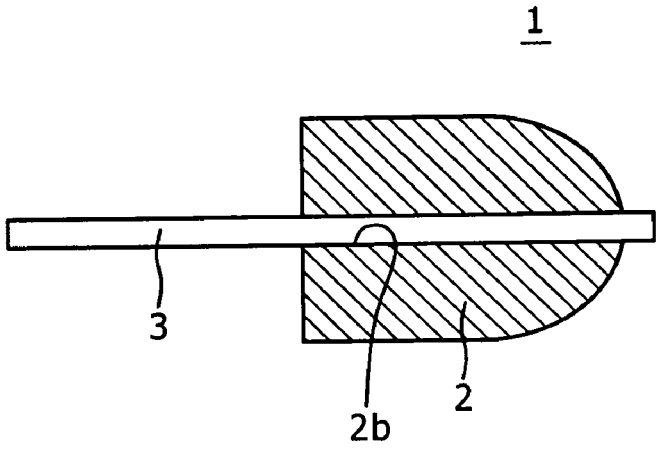
FIG. 3 is a schematic sectional view showing a further example of the short arc type high voltage electrical discharge electrode 1 according to an embodiment of the present invention.

The center hole 2*a* of the electrode main body 2 cannot be restricted to the configuration in which the tip thereof is blocked up as shown in FIGS. 1B and 2B, but can be formed of a through-hole, and can also be configured in which the tip of the electrode center spindle 3 projects to the apex of the electrode main body 2. As shown in FIG. 3, for example, the tip of the short arc type high voltage electrical discharge electrode 1, which is similar to the one mentioned above, smoothly curves in a convex such as a spherical surface, an ellipsoid, a paraboloid or the like, and forms the electrode main body being rotational symmetry to the axial center. A center through-hole 2*b* is formed at the axial center of the electrode main body 2, and the short arc type high voltage electrical discharge electrode 1 can be configured by inserting the electrode center spindle 3 into the center through-hole 2*b* so that the tip 3*a* of the electrode center spindle 3 may project from the apex to pierce the electrode main body 2.

Another Embodiment of Short Arc Type High Voltage Electrical Discharge Electrode Another embodiment of the short arc type high voltage electrical discharge electrode according to the present invention has a configuration in which the fixed contact area of the electrode main body 2 and the electrode center spindle 3 is made to be larger than that of the short arc type high voltage electrical discharge electrode composed of the electrode main body 2 and the electrode center spindle 3, each made of the sintered body of the refractory metal. That is, the contact area of the electrode main body 2 and the electrode center spindle 3 in the state in which the electrode center spindle 3 is inserted into the center hole 2*a* or the center through-hole 2*b* of the electrode main body 2 to be united is desirably 0.9 $mm^2$ or more, and is preferably within a range of from 0.9 $mm^2$ to 3.2 $mm^2$. Hereupon, the contact area is defined as a contact of the degree to influence heat conduction, and it is supposed that all the cases of the contacts in a sintered body including voids in microns are the contact area.

If the contact area is 0.9 $mm^2$ or more, luminous efficiency is raised more. If the contract area is 0.9 $mm^2$ or less, symptoms such as blackening and the like appear on the inner wall of the tube body (e.g. a quartz tube) owing to the temperature down in the quartz tube when the short arc type high voltage electrical discharge electrode is applied to a short arc type high voltage electrical discharge tube, which will be described later. If the contact area is larger than 3.2 $mm^2$, the electrode becomes longer physically, and a disadvantage in which the electrode cannot be housed in the tube body arises.

Moreover, it is proper to set the diameter of the electrode center spindle 3 to be within a range of from 0.25 mm to 0.5 mm, preferably from 0.25 mm to 0.35 mm, in view of the efficiency of heat conduction and the avoidance of the explosion of an electrical discharge tube sealing portion. The diameter of the electrode center spindle is, for example, the diameter of the electrode center spindle when the cross section thereof is a circle, or the width of a line passing through the center of the electrode center spindle when the cross section thereof is a square shape (such as a quadrilateral, a polygon having sides more than four, and the like). If the diameter of the electrode center spindle 3 is smaller than 0.25 mm, the efficiency of heat conduction falls. If the diameter thereof is larger than 0.5 mm, there is a possibility that an explosion takes place at the electrical discharge tube sealing portion.

By using an electrode obtained by a metal powder injection molding method or a powder pressing method, which will be described later, as the short arc type high voltage electrical discharge electrode of the present embodiments, the contact area of the electrode main body 2 and the electrode center spindle 3 can be made to be large and to be stabilized.

In addition, from the viewpoint of the luminous efficiency, the configuration of setting the contact area of the electrode main body and the electrode center spindle to be within the range of from 0.9 $mm^2$ to 3.2 $mm^2$ can be applied not only to the manufacturing methods and the electrode materials which will be described later, but also to short arc type high voltage electrical discharge electrodes widely.

Embodiments of Manufacturing Methods of Short Arc Type High Voltage Electrical Discharge Electrodes First, a temporarily sintered electrode main body 12 for manufacturing the electrode main body 2 is produced.

Figure 4A:
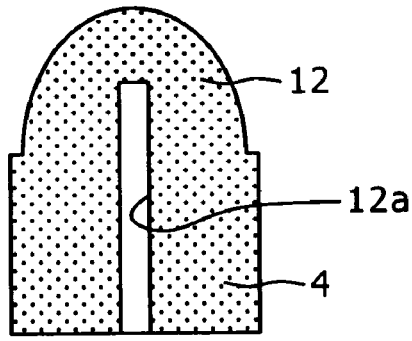
FIGS. 4A and 4B are schematic sectional views showing examples of a temporarily sintered electrode main body and an electrode center spindle, respectively.

FIG. 4A is a schematic sectional view of the temporarily sintered electrode main body 12.

Figure 4B:
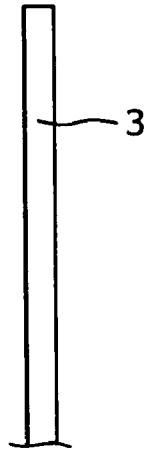

On the other hand, the electrode center spindle 3 is prepared. FIG. 4B is a schematic sectional view of the electrode center spindle 3. Although the electrode center spindle 3 is produced by a wire drawing treatment after the powder metallurgy of a refractory metal, the electrode center spindle 3 may be produced by a powder injection molding method or a powder molding method using powder pressing method, each method using the refractory metal powder. Then, by sintering the molded body, the electrode center spindle 3 is produced.

Moreover, the temporarily sintered electrode main body 12 mentioned above is produced as follows. First, by the powder injection molding method or the powder molding method by the powder pressing method, which methods use the refractory metal powder, a powder molded body of a shape corresponding to the shape of the electrode main body 2 which is finally produced is produced.

The powder molded body is made to be a molded body capable of self hold of the degree of enabling a handling operation of taking out of a molding metal mold or a pressing machine.

The powder molded body is made into the shape corresponding to the electrode main body 2, which is finally formed. That is, as mentioned above, the tip of the powder molded body smoothly curves in a convex such as a spherical surface, an ellipsoid, a paraboloid or the like, and is formed to be, for example, a hanging bell, which has rotational symmetry to the axial center of the powder molded body. Then, a center hole 12*a* corresponding to the center hole 2*a* is formed. Moreover, when the radiator fins 4 are formed on the circumferential surface of the electrode main body 2, fins 14 corresponding to the radiator fins 4 are molded on the circumferential surface of the powder molded body in one body.

The powder molded body of the electrode main body formed in such a manner is temporarily sintered to produce the temporarily sintered electrode main body 12.

Figure 5:
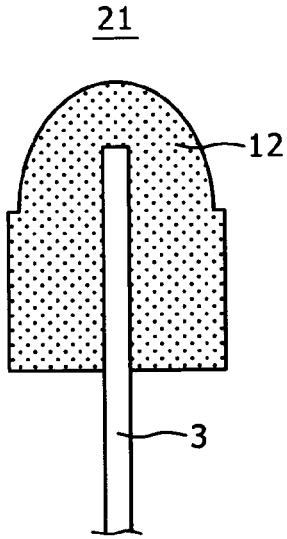
FIG. 5 is a schematic sectional view showing the electrical discharge electrode structure 21.

Then, the tip portion of the electrode center spindle 3 is inserted into the center hole 12*a* of the temporarily sintered electrode main body 12, and an electrical discharge electrode structure is obtained. FIG. 5 is a schematic sectional view of the electrical discharge electrode structure 21.

Next, the final sintering heat treatment is performed to the electrical discharge electrode structure 21.

Thus the electrode main body 2 made to have a true density by the final sintering of the temporarily sintered molded body 12, and at the same time the sintering combination of the electrode main body 2 and the electrode center spindle 3 inserted into the electrode main body 2 is performed. That is, the electrode main body 2 and the electrode center spindle 3 are sintered to each other at their contact portion to be mechanically combined to one body. The electrode main body 2 is formed. That is, to the electrode main body 2, at least two times of sintering processing of first sintering of the temporary sintering mentioned above and second sintering of the final sintering to the electrical discharge electrode structure 21 are performed.

In such a way, the short arc type high voltage electrical discharge electrode 1 according to the present embodiment is obtained.

The temporary sintering to the powder molded body mentioned above indicates the sintering of the degree at which a void content higher than that of the electrode center spindle 3 before the sintering combination by the final sintering mentioned above remains in the temporarily sintered electrode main body 12. Moreover, the temporary sintering also indicates the sintering of the degree enabling the necessary and sufficient elimination of binder to the degree at which almost all the binder existing in the powder molded body has disappeared and no remaining binder substantially influences the characteristics of the electrode center spindle 3 at the contact portion of the temporarily sintered electrode main body 12 and the electrode center spindle 3.

Moreover, because the temporarily sintered electrode main body 12 has been sintered to the degree at which the elimination of binder is necessarily and sufficiently performed in the temporary sintering state as mentioned above and the shrinkage ratio of the electrode center spindle 3 is made to be smaller than that of the temporarily sintered electrode main body 12, the electrode center spindle 3 to be prepared properly has a void content of 10% or less, preferably 5% or less.

Powder molding of the electrode main body 2 can be performed by, for example, the metal powder injection molding method (or Metal-Injection-Mold (M.I.M.)). But as a manufacturing method capable of decreasing the number of processes and of acquiring a stable electrode shape, the powder molding is desirably performed by the metal powder injection molding method. Although the electrode center spindle 3 may be molded by the powder molding similarly to the electrode main body 2, it is desirable that the void content is small to be near to the true density. Moreover, in consideration of mechanical strength, the one subjected to the wire drawing treatment after the powder metallurgy is preferable.

Although the short arc type high voltage electrical discharge electrode is produced through the sintering heat treatment after inserting the finally sintered electrode center spindle into the temporarily sintered electrode main body as mentioned above, it is preferable to produce the short arc type high voltage electrical discharge electrode so that the contact area of the electrode center spindle and the electrode main body may be within a range of from 0.9 $mm^2$ to 3.2 $mm^2$.

EXAMPLE 1

In this example, the powder molded body was obtained by the metal powder injection molding method.

In this case, a paste of a kneaded material in the state in which metal powder and a binder were kneaded was obtained.

Tungsten powder or tungsten powder consisting of tungsten (W) as the principal component and the so-called dopant, such as kalium (K), rhenium (Re) and the like, which suppressed recrystallization and suppressed embrittlement, within 5 wt % or less, preferably 100 ppm or less, could be used as the metal powder. The metal powder and a binder of paraffin series or the like were kneaded to acquire the paste mentioned above. The paste was being heated to about 100° C. to about 200° C. as the need arose while the pressure injection molding of the paste into a metal mold having an inner form corresponding to the outer form of the electrode main body 2 of the object was performed. The powder molded body molded in such a way was taken out of the metal mold.

The powder molded body was subjected to the temporary sintering, i.e. first sintering processing, to produce the temporarily sintered electrode main body 12 shown in FIG. 4A. The temporary sintering was set to the sintering to the degree enabling the elimination of the binder and acquiring the strength enabling handling such as picking up the temporarily sintered electrode main body 12. The density of the temporarily sintered electrode main body 12 at this time was made to 85% or less of the true density in the case of tungsten, for example.

In the case where the metal powder in the powder injection molding mentioned above, for example tungsten powder, was used, the average particle diameter of the metal powder was set to be within a range of from 1 μm to 10 μm, preferably from 1 μm to 3 μm, for example 2 μm. The selection of the metal powder particle diameter was based on the following reason. If the particle diameter was too small, there was the possibility that unpreferable phenomena such as a rapid advance of oxidation owing to the increase of a surface area, and a rapid crystal growth owing to the increase of the contact surface area of powder. If the particle diameter was too large, it became difficult to cause sintering.

On the other hand, the finally sintered electrode center spindle 3 shown in FIG. 4B was configured. It was desirable to constitute the electrode center spindle 3 using the same material as that of the electrode main body 2. Similarly, a powder molded body constituting the electrode center spindle 3 was produced by, for example, the metal powder injection molding, and the powder molded body was subjected to the final sintering heat treatment to configure the electrode center spindle 3 having a low void content and a high true density.

Then, the tip portion of the finally sintered electrode center spindle 3 was inserted into the center hole 12*a* of the temporarily sintered electrode main body 12 to configure the electrical discharge electrode structure 21 shown in FIG. 5.

Next, the sintering to the electrical discharged electrode structure 21, i.e. the second sintering mentioned above, was performed to make the temporarily sintered electrode main body 12 to the electrode main body 2. Moreover, the electrode main body 2 and the electrode center spindle 3 were combined with each other by the sintering to configure the short arc type high voltage electrical discharge electrode 1.

The selection of the shrinkage ratio and the size form of the temporarily sintered electrode main body 12 was made so that the whole inner circumferential surface of the center hole 12 and the outer circumferential surface of the electrode center spindle 3 to be inserted into the center hole 12*a* might adhere closely to each other in just proportion, and so that the sintering combination of the temporarily sintered electrode main body 12 with the electrode center spindle 3 might be performed to be in good condition by pressing the electrode center spindle 3 hard by the shrinkage of the temporarily sintered electrode main body 12 by the second sintering in the assembly of the electrical discharge electrode structure 21 in the manufacturing of the short arc type high voltage electrical discharge electrode 1. The design for the selection can be performed with sufficient accuracy.

In the manufacturing method mentioned above, the first sintering temperature of the powder molded body constituting the electrode main body was set to 14000° C. If the sintering temperature was too low, the handling strength was weak, and the issue of the residue of the binder was generated. If the sintering temperature was too high, cracks and breakages were produced, and the size accuracy was lowered. Consequently, the first sintering temperature was preferably within a range of from 1100° C. to 1400° C., preferably a range of from 1300° C. to 1400° C. The first sintering was performed for three hours.

Figure 6:
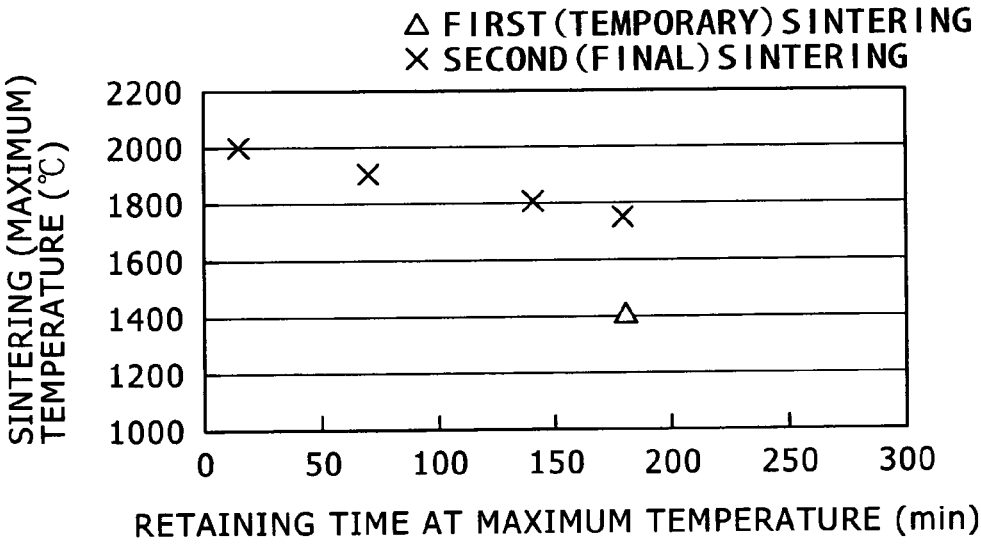
FIG. 6 is a diagram showing a relationship of the maximum temperatures and retaining time at the time of sintering.

Moreover, the second sintering temperature mentioned above, i.e. the time of the sintering to the electrical discharge electrode structure, was able to set 70 minutes at 1900° C. in the tungsten powder. The sintering temperature was within a range of from 1750° C. to 2000° C. (theoretical recrystallization temperature of tungsten), preferably a range of from 1900° C. to 2000° C. The retaining time at the temperature of 1750° C. was 180 minutes, and the retaining time at the temperature of 1900° C. was 70 minutes. FIG. 6 is a diagram showing a relationship between the maximum temperature at the time of sintering and the retaining time. The density of the electrode main body 2 was made to be 95% or more of the true density by the second sintering.

Because the shrinkage ratio of the temporarily sintered electrode main body 12, the void content of which was larger than that of the electrode center spindle before the second sintering, was larger than the electrode center spindle 3, the sintered electrode main body 2 and the electrode center spindle 3 disposed at the center of the electrode main body 2 were solidly combined with each other by the second sintering.

The shrinkage ratio of the main body 2 was set so that the shrinkage of about 20% was produced to the volume of the powder molded body.

Moreover, because the binder of the electrode main body 2 had been eliminated or almost eliminated by the first sintering, the embrittlement caused by recrystallization of the electrode center spindle 3 owing to the impurities was avoided at the time of the second sintering.

Moreover, the second sintering also served as the exhaustion of gasses, and, for this reason, the second sintering was performed in the vacuum around $1\times10^{-3}$ Pa.

The vacuum high temperature heat treatment, which was usually performed with an object of the exhaustion of gasses after the manufacturing of the electrode 1, of the short arc type high voltage electrical discharge electrode 1 obtained in this way was unnecessary.

That is, as a result of the actual analysis of the oxidation degree and the carbonization degree in the depth direction of the molded body after sintering by the Auger analysis in the case of molding by the powder injection molding method, the depths of the oxidation and the carbonization from the surface was observed at the same depths as those of the cases of related art, and the depths were considered to be 6 nm to 7 nm. Thus, good results were obtained.

Moreover, the short arc type high voltage electrical discharge electrode 1 after the sintering can be inserted into an arc tube as it is to be assembled therein. Consequently, when a short arc type high voltage electrical discharge tube is manufactured using the short arc type high voltage electrical discharge electrode 1, the manufacturing process thereof can be simplified.

EXAMPLE 2

In this example 2, the manufacturing method of a powder molded body was performed by the powder pressing.

In the powder pressing method, granulated powder obtained by the granulation of mixed powder into a granular state which powder was obtained by mixing a binder such as paraffin series into tungsten powder of tungsten or tungsten containing an added dopant similar to those described in the example 1 was filled up into a pressing metal mold, and the granulated powder was subjected to the press molding by, for example, the vertical punching method.

Thus, the powder molded body of the electrode main body was produced. To this powder molded body, the same temporary sintering, i.e. the first sintering, as that of the example 1 was performed, and the temporarily sintered electrode main body 12 was manufactured.

On the other hand, similarly in the example 1, the electrode center spindle 3 was prepared, and the electrode center spindle 3 was inserted into the center hole 12*a* of the temporarily sintered electrode main body 12. Then, the second sintering similar to that of the example 1 was performed, and thus the short arc type high voltage electrical discharge electrode 1 in which the electrode main body 2 and the electrode center spindle 3 were combined by the sintering to be one body was manufactured.

Also by the example 2, it was able to acquire the same excellent short arc type high voltage electrical discharge electrode 1 as the example 1.

EXAMPLE 3

In the present example, the short arc type high voltage electrical discharge electrode 1 was produced by setting the contact area of the electrode center spindle 3 and the electrode main body 2 to 0.9 $mm^2$ to 3.2 $mm^2$ in the manufacturing methods of the examples 1 and 2. In the example 3, the excellent short arc type high voltage electrical discharge electrode 1 similar to those of the examples 1 and 2 could be obtained, and the short arc type high voltage electrical discharge electrode 1 having a raised luminous efficiency was able to be obtained.

A short arc type high voltage electrical discharge tube was manufactured using the short arc type high voltage electrical discharge electrode 1 manufactured in this way.

Figure 7:
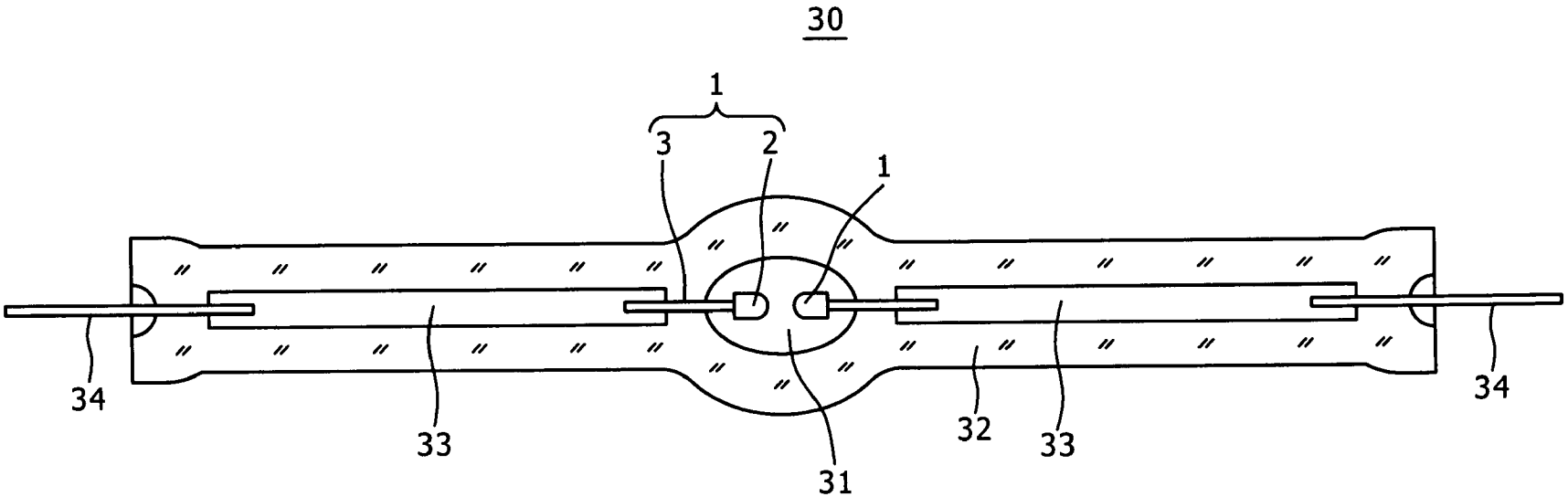
FIG. 7 is a schematic sectional view of an example of a short arc type high voltage electrical discharge tube obtained by a manufacturing method according to an embodiment of the present invention.
Figure 8:
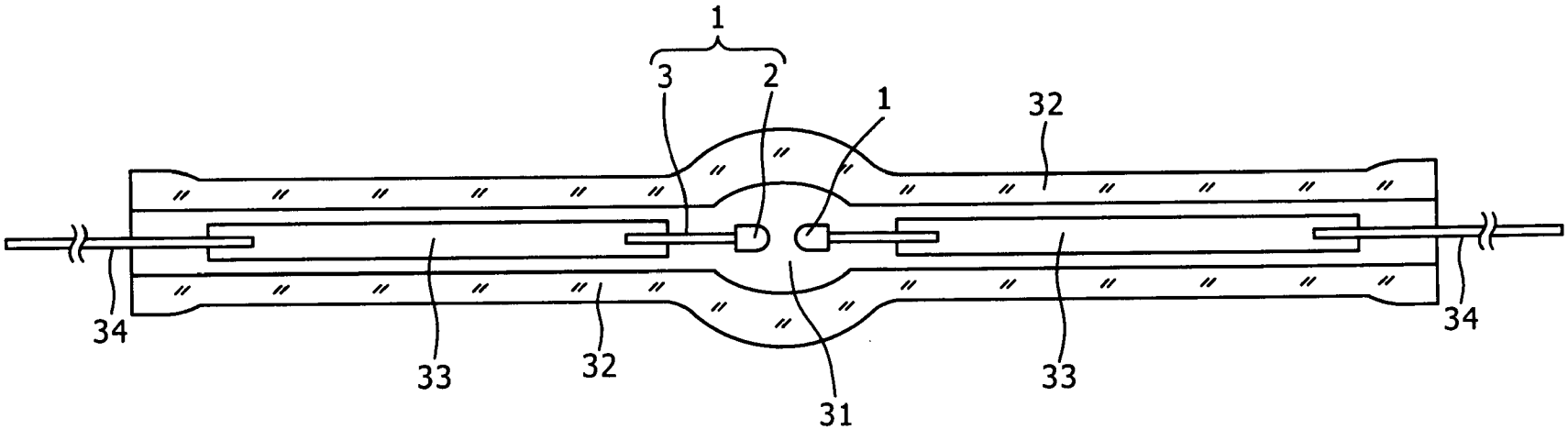
FIG. 8 is a schematic sectional view of an example of the short arc type high voltage electrical discharge tube in a manufacturing process of the manufacturing method of FIG. 6.

Embodiments of Short Arc Type High Voltage Electrical Discharge Tube and Manufacturing Method Thereof FIG. 7 is a schematic sectional view of an example of a short arc type high voltage electrical discharge tube 30 obtained by the present embodiment. Moreover, FIG. 8 is a schematic sectional view in a manufacturing process of an example of the short arc type high voltage electrical discharge tube.

In this case, a sealing metal foil 33 made of, for example, a molybdenum foil for suppressing the conduction of heat by the high temperature exceeding 2000° C. at the time of an electrical discharge is welded to the end of each of the electrode center spindles 3 of a pair of short arc type high voltage electrical discharge electrodes 1 according to the present embodiment produced by the manufacturing method according to the present embodiment mentioned above. Furthermore, a lead 34 is welded to the outer end of the sealing metal foil 33.

The short arc type high voltage electrical discharge tube 30 is composed of, for example, a quartz electrical discharge tube body 32, both the ends of which are sealed. As shown in FIG. 8, a pair of short arc type high voltage electrical discharge electrodes 1 to which the sealing metal foils 33 and the leads 34 are attached are inserted into the tube body 32 so that each tip of the short arc type high voltage electrical discharge electrodes 1 may keep a predetermined interval between them.

In this state, as shown in FIG. 7, a sealed hollow 31 enclosing the disposed portions of the tip portions of the short arc type high voltage electrical discharge electrodes 1 is formed in the electrical discharge tube 32, and then the electrical discharge tube body 32 is heated to be softened so as to seal the electrical discharge tube body 32 at both the ends of the sealing metal foils 33. In the sealed state, the outer end of each of the leads 34 is derived to the outside. At this time, each part after the welding is washed and an annealing treatment also for the exhaustion of gasses are performed as the need arises.

The thickness of the molybdenum metal foil 33 can be set to 20 μm, for example.

The electrical discharge tube body 32 can be formed of the quartz tube mentioned above or a light transmitting ceramic container.

In the manufacture of the short arc type high voltage electrical discharge tube, the washing and the annealing treatment of the electrical discharge tube body 32 are performed as the need arises, and after that, as mentioned above, the short arc type high voltage electrical discharge electrodes 1 to which the sealing metal foils 33 and the leads 34 are attached are inserted into the electrical discharge tube body 32. The inside of the tube body 32 is exhausted while the sealing, the so-called shrink seal, of one of the end sides of the tube body 32 is performed by softening the quartz by a $CO_2$ laser or an oxygen-hydrogen mixing gas burner. Alternatively, the sealing is performed by the pinch seal method sealing the softened quartz mechanically.

After that, a rear gas as a starting gas or a buffer gas such as any one of Ar, Xe and Kr, and a light emitting metal such as mercury or metal iodide, and further bromine or metal bromide for a halogen cycle as the need arises, and the like are inserted into the tube body 32 from the other end thereof. After that, the end is sealed at the sealing metal foil 33 similarly to the method mentioned above, and the other lead 34 is derived from the end to the outside.

The electrode interval of both the short arc type high voltage electrical discharge electrodes 1 is set to, for example, 1 mm to 4.5 mm, preferably 1 mm to 2 mm.

Thus, the short arc type high voltage electrical discharge tube 30 is configured.

Other Embodiments of Short Arc Type High Voltage Electrical Discharge Tube and Manufacturing Method Thereof Although the short arc type high voltage electrical discharge tube 30 according to the present embodiment is basically configured as shown in FIG. 6, the short arc type high voltage electrical discharge tube 30 is configured to use short arc type high voltage electrical discharge electrodes in which each of the contact areas of the electrode main bodies 2 and the electrode center spindles 3 produced by the manufacturing method of the present embodiment mentioned above is made to be within a range of from 0.9 $mm^2$ to 3.2 $mm^2$ as the short arc type high voltage electrical discharge electrode 1.

In a concrete example, in the fixing of the electrode main body 2 and the electrode center spindle 3, the contact area of the electrode main body 2 of a completed body and the electrode center spindle 3 of a completed body was set to 3.3 $mm^2$, and the diameter of the electrode center spindle 3 was set to 0.4 mm. As the arc tube container, the electrical discharge tube body 32 of quartz was used, for example. In addition, as the arc tube container, an electrical discharge tube body which consisted of the other light transmitting ceramics or the like could be also used.

In the manufacture of the short arc type high voltage electrical discharge tube, washing and annealing treatment were performed to the electrical discharge tube body 32 as the need arose. After that, one electrode assembly of the pair of electrode assemblies with leads mentioned above, each of which the electrode 1, the sealing metal foil 33 and the lead 34 were integrally fixed, was inserted into one side of the electrical discharge tube body 32. The inside of the tube body 32 was exhausted while the quartz was softened by a $CO_2$ laser, an oxygen-hydrogen mixing gas burner or the like to perform the sealing of the other side of the tube body 32, the so-called shrink seal. Alternatively, in place of the shrink seal, the other side was sealed by the pinch seal method.

After that, a rare gas (any of Ar, Xe and Kr), Xe in the present example, and a metal iodide (0.5 mg of dysprosium iodide, 0.5 mg of lutetium iodide, and 0.2 mg of gallium iodide) were inserted into the electrical discharge tube body 32, one side of which was sealed, from the end of the other side as a starting gas or a buffer gas. Subsequently, an electrode assembly with a lead was inserted onto the other side of the electrical discharge tube body 32, and the electrode interval of the electrode assemblies was adjusted to a desired interval within a range of from 1 mm to 4.5 mm, or the like. Then, the shrink seal thereof was performed, and the short arc type high voltage electrical discharge tube 30 was completed. In the concrete example, the electrode interval was set to 1.3 mm, and the electrical discharge space capacity was set to 60 $mm^3$.

Thus, the short arc type high voltage electrical discharge tube 30 was produced.

Figure 9:
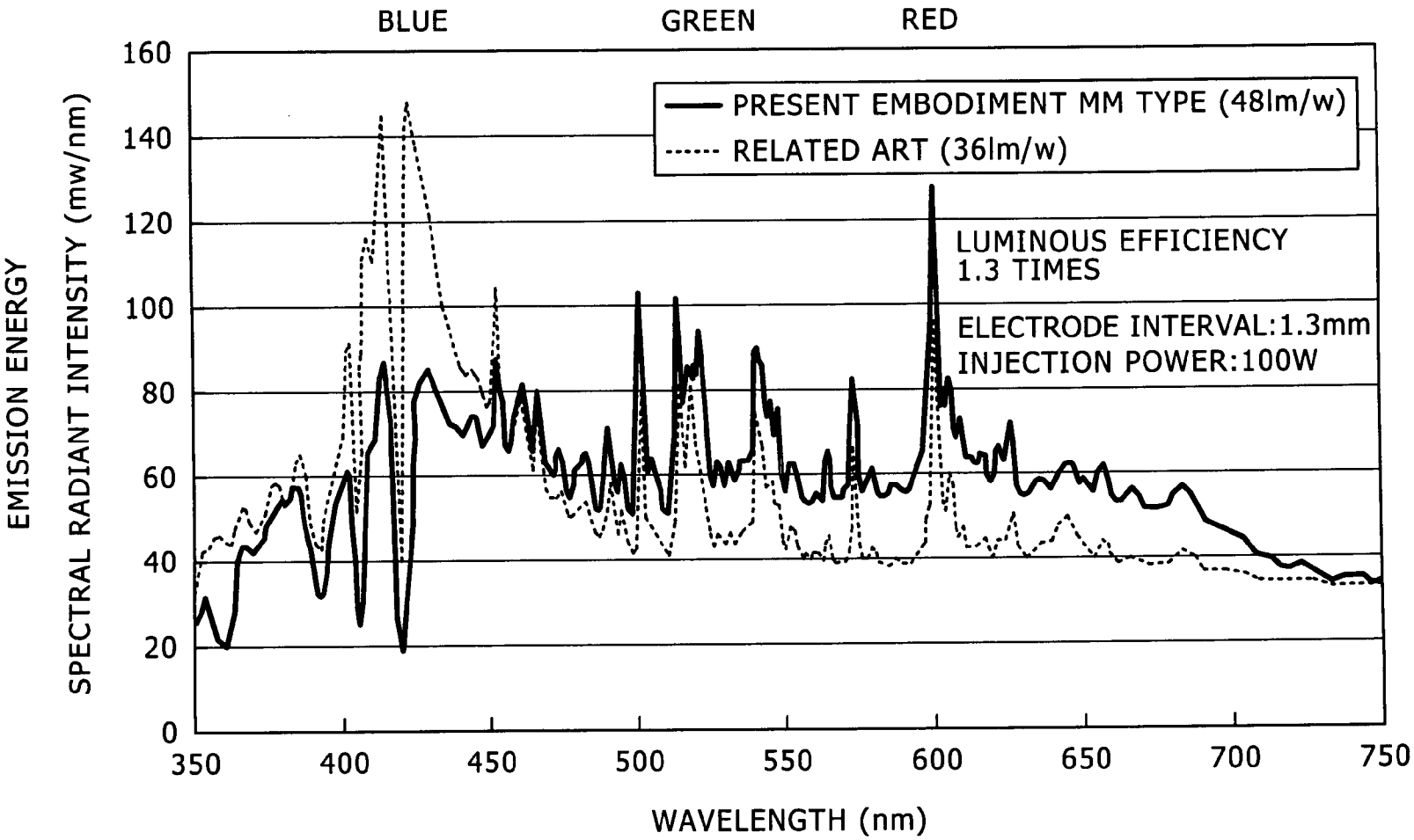
FIG. 9 is a spectral atlas of short arc type high voltage electrical discharge tubes of an embodiment of the present invention and related art.
Figure 13:
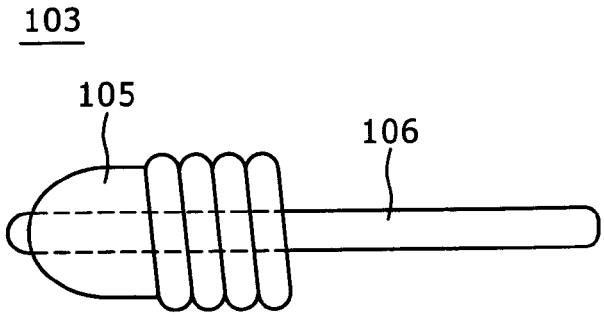
FIG. 13 is a side view of a general electrical discharge electrode of related art.
Figure 14A:
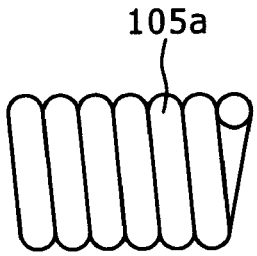
FIGS. 14A and 14B are side views showing the electrode main body and the center spindle member, respectively, of the short arc type high voltage electrical discharge electrode of related art.
Figure 14B:
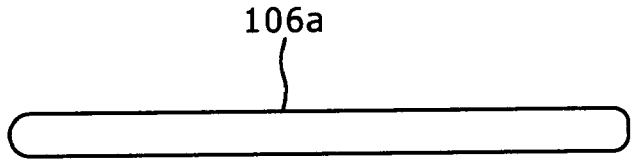
Figure 15:
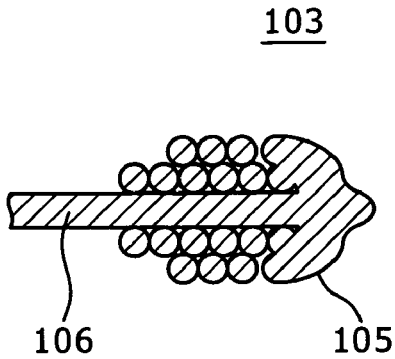
FIG. 15 is a schematic sectional view of the short arc type high voltage electrical discharge electrode of related art.

The short arc type high voltage electrical discharge tube 30 of the concrete example produced in this way was operated by 100 W, and the operation was compared with that of an electrical discharge tube equipped with an electrode of related art type, which was a similar structure. In the related art type electrode 103, the contact area of the electrode center spindle 106 shown in FIGS. 13, 14A and 14B and the melting portion, which was regarded as the electrode main body 105, by a YAG laser was 0.6 $mm^2$, and the diameter of the center spindle 106 is 0.4 mm. When both were compared, the lamp current of the related art type was 4 A, on the other hand, the lamp current of the present embodiment was reduced to 3.4 A. The luminous efficiency of a type of related art was 36 ml/W, and that of the present embodiment was improved to 48 lm/W by 30& %. FIG. 9 shows spectra of the present invention (solid line) and a type of related art (dashed line). From the spectra, it is perceived that the short arc type high voltage electrical discharge tube of the present embodiment has uniform intensity throughout visible light wave lengths.

In order to actually use the short arc type high voltage electrical discharge tube 30 for a liquid crystal projector and the like, the short arc type high voltage electrical discharge tube 30 is inserted into a reflector 41, which will be described later, and the alignment fixing thereof is carried out to be installed thereon. Although the example was described to use a metal halide lamp, it cannot be overemphasized that the same effect can be obtained also by an extra-high voltage mercury lamp (UHP).

The inventors of the present invention examined the relationship between the contact area at the fixing portion of the electrode main body and the electrode center spindle and the luminous efficiency. Then, the inventors ascertained that, if the contact area of the present embodiment was 0.9 $mm^2$ or more in comparison with 0.6 $mm^2$ of the contact area of the related art type electrode (the contact area of the inner portion of the hanging bell-like melted portion calculated from the length and the diameter of the center spindle before being melted in the electrode main body 105 (melted portion by a YAG laser) and the electrode center spindle 106), the luminous efficiency of the present embodiment rose than that of the related art type. Although even the luminous efficiency of the related art type sometimes rises by enlarging the diameter of the center spindle 106, the danger of the explosion of the electrical discharge tube sealing portion increases in that case. Consequently, it is desirable to increase the contact area with the electrode main body as much as possible while the diameter of the center spindle is left to be small.

The reason why the luminous efficiency rises when the contact area of the electrode main body and the electrode center spindle becomes larger is described. During the operation of the electrical discharge tube, the temperature of the electrode main body rises. The heat is conducted to the inner wall of the electrical discharge space of the quarts tube body via the electrode center spindle. Hereupon, when the contact area of the electrode main body and the electrode center spindle becomes larger, the heat conduction becomes larger, and the temperature of the inner wall of the quartz tube efficiently rises. By the rise of the temperature of the inner wall of the quartz tube, the luminous metal vapor pressure (saturated vapor pressure) in the arc electrical discharge portion rises, and the plasma density formed between the electrodes becomes larger. Thus the lamp voltage between the electrodes rises to raise the luminous efficiency.

Moreover, when the luminous metal vapor pressure rises, an arc shrinkage (the so-called self shrinkage of the arc plasma) is caused between the pair of electrode main bodies, and an electric electrical discharge state nearer to a point light source can be obtained.

Figure 10:
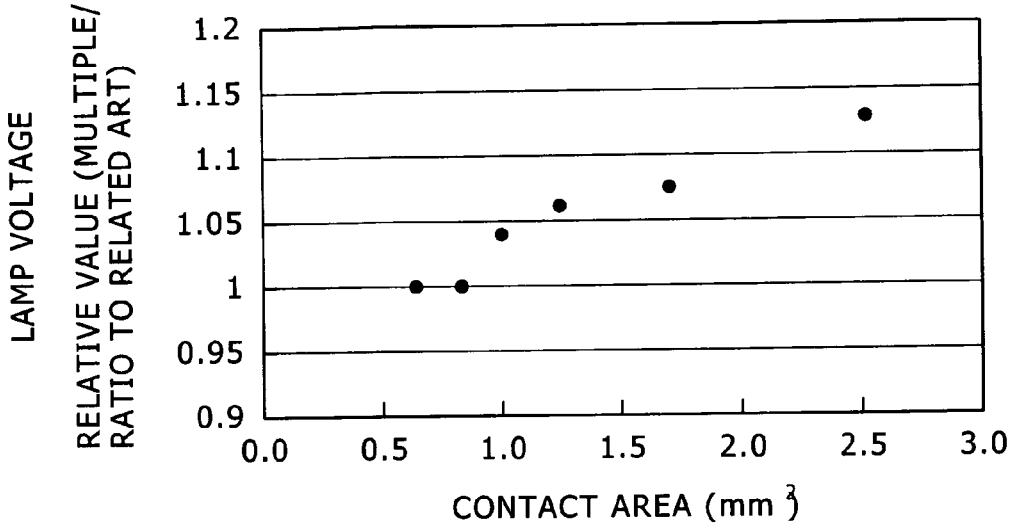
FIG. 10 is a graph showing a relationship between the contact area of the electrode main body and the current center spindle in a short arc type high voltage electrical discharge electrode, and lamp voltages.

FIG. 10 shows a relationship between the contact areas of the electrode main body and the electrode center spindle and the lamp voltages. FIG. 10 takes the contact areas ($mm^2$) along the abscissa axis thereof and the relative values (namely, the multiple numbers of the lamp voltages to the lamp voltage of the related art type when the latter lamp voltage was set to one) of the lamp voltages. From the data shown in FIG. 10, when the diameter of the electrode center spindle is set to be within a range of from 0.25 mm to 0.5 mm, preferably from 0.25 mm to 0.35 mm, and the contact area is set to be within the range of from 0.9 $mm^2$ to 3.2 $mm^2$ (preferably 2.5 $mm^2$ or more), the lamp voltage rises in comparison with that of the related art type. Although FIG. 10 shows an example using the metal halide lamp, the relationship is similar to the case where an extra-high voltage mercury lamp (UHP) is used. As described above, when the contact area is smaller than 0.9 $mm^2$, symptoms such as blackening and the like owing to the temperature down in the quartz tube appear on the inner wall of the quartz tube. When the contact area is 2.5 $mm^2$ or more, the lamp voltage is saturated. When the contact area exceeds 3.2 $mm^2$, there is the possibility that the electrode physically becomes long not to be housed in the tube body. Then, 3.2 $mm^2$ is a practical upper limit.

Figure 11:
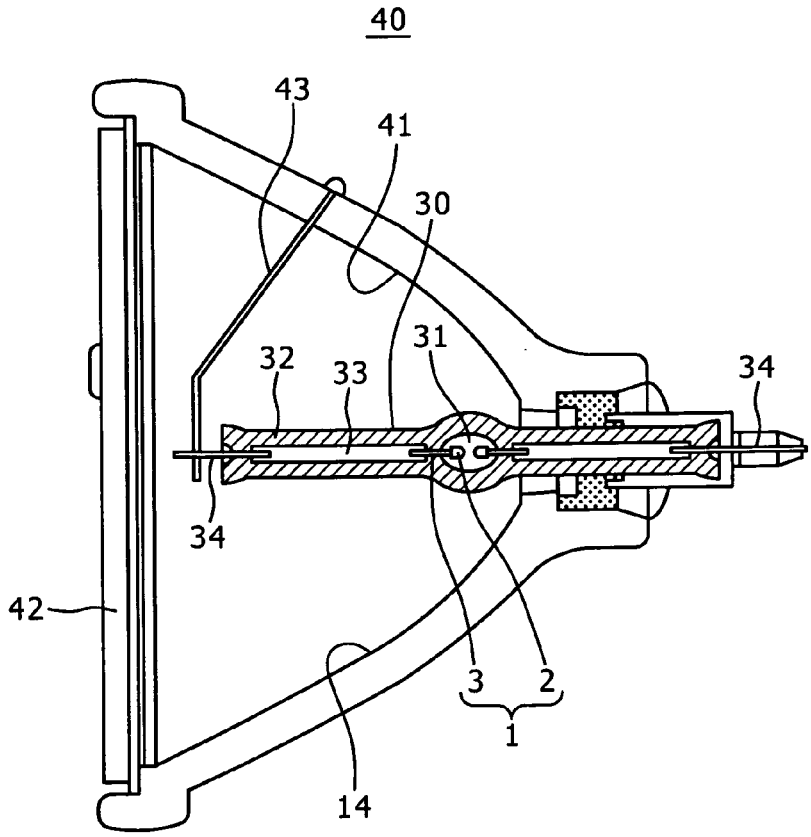
FIG. 11 is a schematic sectional view showing an example of a short arc type high voltage electrical discharge light source apparatus 40.
Figure 12:
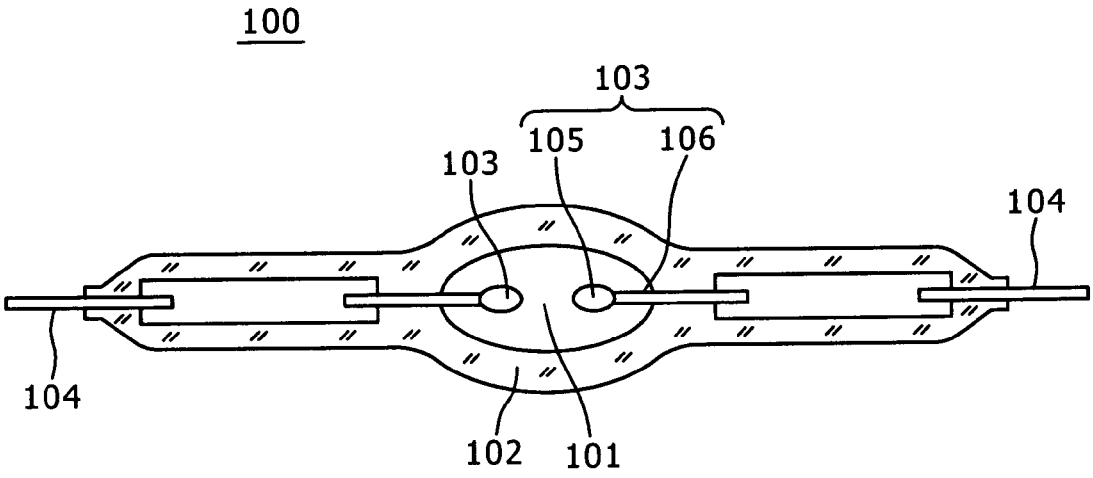
FIG. 12 is a schematic sectional view of a short arc type high voltage electrical discharge tube of related art.

In the present embodiment, for example, a short arc type high voltage electrical discharge light source apparatus 40 used as a light source such as liquid crystal projector and the like is manufactured using the short arc type high voltage electrical discharge tube 30 manufactured in such a way. FIG. 11 is a schematic sectional view of an example of the short arc type high voltage electrical discharge light source apparatus 40.

Short Arc Type High Voltage Electrical Discharge Light Source Apparatus and Embodiment of Manufacturing Method Thereof In the short arc type high voltage electrical discharge light source apparatus 40, the reflector 41 in a cone of a paraboloid, for example, and transparent front panel 42 sealed on the front opened side of the reflector 41 are arranged. An enclosed space is configured by the reflector 41 and the front panel 42.

Then, the short arc type high voltage electrical discharge tube 30 manufactured by the manufacturing method of the present embodiment mentioned above are housed to be disposed on the axial center of the reflector 41 in the enclosed space, and the emitted light owing to an electrical discharge optical emission from the short arc type high voltage electrical discharge tube 30 is radiated into a predetermined direction.

A deriving lead 43 is connected to the lead 34 on the front side of the short arc type high voltage electrical discharge tube 30, and terminal deriving is performed from the middle of the reflector 41 to the outside.

Moreover, the terminal deriving of the other lead 34 is electrically performed from the rear end of the reflector 41 to the outside.

The electrical discharge optical emission characteristic of the short arc type high voltage electrical discharge tube 30 of the short arc type high voltage electrical discharge light source apparatus 40 manufactured in such a way is stable. When the short arc type high voltage electrical discharge tube 30 was disjointed after electrical discharge for 100 hours and the observation of the electrical discharge electrode was performed, it was ascertained that the electrode main body was not changed from the initial state before the electrical discharge to hold a good shape.

Although the example described above is related to the case where the second sintering is performed only in the manufacturing process of the short arc type high voltage electrical discharge electrode 1, at least a part of the sintering process can also be progressed by the following way. That is, the short arc type high voltage electrical discharge electrode 1 is mounted on, for example, the short arc type high voltage electrical discharge tube 30 or the short arc type high voltage electrical discharge light source apparatus 40, and the lighting of the short arc type high voltage electrical discharge electrode 1 is performed for a short time, for example, for five minutes, and the short arc type high voltage electrical discharge electrode 1 is operated for the time for aging, for example. Thereby, the temperature of the short arc type high voltage electrical discharge electrode 1 is raised to 2000° C. or higher by the heat generation owing to ion impact or the like. Then, the second sintering operation can be advanced by the use of the raised heat. At this time, although the light emitting metal and the like enclosed in the electrical discharge tube body has also been vaporize in the tube body, the voids in the electrode main body have been substantially obstructed already in the lamp putting out process after the sintering, and the light emitting metal gathers to portions where cooling is rapid (electrode center spindle and tube wall) owing to the temperature distribution in the tube. Consequently, there is no possibility that the metal vapor enters in the electrode main body.

When the short arc type high voltage electrical discharge light source apparatus 40 is equipped with an electrical discharge tube in which the contact area of the electrode main body and the electrode center spindle is within a range of from 0.9 $mm^2$ to 3.2 $mm^2$, which serves as the short arc high voltage electrical discharge tube, the electrical discharge efficiency of the short arc type high voltage electrical discharge light source apparatus 40 is further improved, and an electrical discharge state nearer to the point light source can be obtained as mentioned above.

When the short arc type high voltage electrical discharge light source apparatus 40 is used for, for example, a liquid crystal projector, the screen luminance, i.e. light availability, rises owing to the rise of unique light emission intensity over the whole visible light region. And by the arc shrinkage owing the rise of the luminous metal vapor pressure, the short arc type high voltage electrical discharge light source apparatus 40 becomes nearer to a point light source, and consequently the short arc type high voltage electrical discharge light source apparatus 40 can increase the screen luminance.

As mentioned above, the short arc type high voltage electrical discharge electrode 1 according to the present embodiment avoids the melting molding operation by the irradiation of a laser light to the tip of the electrode main body and the like in the related art, and consequently the number of manufacturing processes of the sort arc type high voltage electrical discharge electrode 1 decreases. Thereby the short arc type high voltage electrical discharge electrode 1 has advantages that the decrease of the contamination from the outside at the time of manufacturing is achieved, and that the quality control thereof is also easy.

Moreover, an inactive gas such as Ar, He or the like is injected as an oxidization prevention measure at the time of laser irradiation. If a plurality of times of laser light irradiation is performed to perform melt formation, a risk of taking in the contamination from the outside increases, and oxidization, carbonization and the like are easily generated. Consequently, the processes of measures such as washing after formation, heat treatment for the exhaustion of gasses and the like also increase. Furthermore, the issue of the decrease of the yield of a manufacturing process is also generated, and there is a defect of the impossibility of stabilized manufacturing. Moreover, the issue of hanging bell portion formation by electrical discharge machining is also the same.

Moreover, in case of the method of manufacturing the electrode main body with the coil of related art, which has been described at the beginning, when lighting during a long term, for example, for 100 hours or longer, is performed, irregular winding in a coil portion is cause to bring about a temperature distribution change, and an electric field concentrates to disturb the electric discharge at the time of lighting. Consequently, the coil of related art has an issue of the reliability of the form quality of the electrode. However, the problems are settled by the present embodiment to achieve the stability thereof.

Furthermore, because the geometry of the electrode manufactured by the metal powder injection molding method (MIM method) is determined based on the conditions of the metal molding and the sintering thereof, a remarkably stable accuracy is secured in comparison with that of the electrode manufactured by the related art.

Moreover, in spite of being able to respond to complicated forms, there are no problems of coil deformation and the like, which occur in the related art, and the improvements of the occurrence of cracks and the like mentioned at the beginning, which causes the instability of reliability and characteristics, and the lowering of yield, can be achieved.

Moreover, when the short arc type high voltage electrical discharge electrode 1 according to the present embodiment is applied to an electrical discharge tube, the luminous efficiency thereof can be improved, and the luminance reliability can be improved by setting the contact area of the electrode main body 2 and the electrode center spindle 3 to be within a range of 0.9 $mm^2$ to 3.2 $mm^2$. Consequently, in injection output operation equivalent to that of the related art, the short arc type high voltage electrical discharge tube of high luminous efficiency can be obtained.

Moreover, if the luminous metal vapor pressure rises, arc shrinkage (so-called self shrinkage of arc plasma) is caused between the pair of electrode main bodies, and an electric discharge state nearer to a point light source appears. Therefore, if the light source apparatus in which such a short arc type high voltage electrical discharge tube is inserted into a reflector to be fixed is used for, for example, a liquid crystal projector or the like, the light source nearer to a point light source is obtained. Consequently, it becomes possible to raise screen luminance.

Moreover, in the present embodiment, because uniform optical intensity can be obtained throughout visible light wavelength as shown in the emission spectrum of FIG. 9, when the present embodiment is applied to, for example, a light source apparatus such as a liquid crystal projector, each of the color lights of red, green and blue is uniformly obtained. Simultaneously, the optical use rate can be improved.

In addition, as shown in FIG. 11, the short arc type high voltage electrical discharge light source apparatus may be configured to arrange the transparent front panel 42 and the reflector 41 in a sealed state, or can also be configured to form an aperture portion communicating the inside and the outside of the reflector 41 at a part of the transparent front panel 42. Furthermore, the short arc type high voltage electrical discharge light source apparatus may be configured to omit the transparent front panel.

When the short arc type high voltage electrical discharge electrode in which the tip 3*a* of the electrode center spindle 3 of FIG. 3 projects from the electrode main body 2 is applied to an electrical discharge tube, the electrode center spindle 3 itself becomes the origin to be heated, and such a configuration is more advantageous one for heat conduction to the inner wall of the quartz tube body. However, in a structure in which an electrode is composed only of the electrode center spindle 3 and the electrode main body 2 does not exist (such a configuration is used, for example, for cars), heat capacity is small, and the tip temperature of the electrode center spindle 3 rises too much. Consequently, such a structure is not suitable for the light source apparatus for a liquid crystal projector.

It should be understood by those skilled in the art that various modifications, combinations, sub-combinations and alterations may occur depending on design requirements and other factors insofar as they are within the scope of the appended claims or the equivalents thereof.

The invention claimed is:

1. A short arc type high voltage electrical discharge electrode, comprising:

an electrode center spindle made from a refractory metal and having a tip; and an electrode main body disposed at the tip of the electrode center spindle, the electrode main body being made from a refractory metal; wherein the electrode center spindle is subjected to a first sintering process to generate a sintered electrode center spindle, the electrode main body is subjected to a second sintering process to generate a sintered electrode main body, and the sintered electrode center spindle is inserted into a center hole of the sintered electrode main body so as to form a combination which is subjected to a third sintering process, a shrinkage ratio of the sintered electrode center spindle is smaller than a shrinkage ratio of the sintered electrode main body, the sintered electrode center spindle has a void content of 5% or less, the combination comprises a plurality of radiator fins, and the contact area of the sintered electrode center spindle and the sintered electrode main body in the state in which the sintered electrode center spindle is inserted into the center hole of the sintered electrode main body is within the range of 0.9 $mm^2$ to 3.2 $mm^2$.

2. A short arc type high voltage electrical discharge electrode, comprising:

an electrode center spindle made of a body of a refractory metal and having a tip; and an electrode main body disposed at the tip of the electrode center spindle, the electrode main body being made of a body of a refractory metal;

wherein a contact area between the electrode main body and the electrode center spindle is within a range of from 0.9 mm2 to 3.2 mm2, the electrode center spindle is subjected to a first sintering process to generate a sintered electrode center spindle, the electrode main body is subjected to a second sintering process to generate a sintered electrode main body, and the sintered electrode center spindle is inserted into a center hole of the sintered electrode main body so as to form a combination which is subjected to a third sintering process, a shrinkage ratio of the sintered electrode center spindle is smaller than a shrinkage ratio of the sintered electrode main body, the sintered electrode center spindle has a void content of 5% or less, the combination comprises a plurality of radiator fins, and the contact area of the sintered electrode center spindle and the sintered electrode main body in the state in which the sintered electrode center spindle is inserted into the center hole of the sintered electrode main body is within the range of 0.9 $mm^2$ to 3.2 $mm^2$.

3. The short arc type high voltage electrical discharge electrode according to claim 2, wherein a diameter of the electrode center spindle is within a range of from 0.25 mm to 0.5 mm.

4. A short arc type high voltage electrical discharge tube, comprising:

a tube body;

a pair of electrical discharge electrodes enclosed in the tube body with a predetermined space between the electrodes;

each of the electrical discharge electrodes including an electrode center spindle made from a refractory metal and having a tip, and an electrode main body disposed at the tip of the electrode center spindle, the electrode main body being made from a refractory metal, for each of the electrical discharge electrodes the electrode center spindle is subjected to a first sintering process to generate a sintered electrode center spindle, the electrode main body is subjected to a second sintering process to generate a sintered electrode main body, and the sintered electrode center spindle is inserted into a center hole of the sintered electrode main body so as to form a combination which is subjected to a third sintering process, a shrinkage ratio of the sintered electrode center spindle is smaller than a shrinkage ratio of the sintered electrode main body, the sintered electrode center spindle has a void content of 5% or less, the combination comprises a plurality of radiator fins, and the contact area of the sintered electrode center spindle and the sintered electrode main body in the state in which the sintered electrode center spindle is inserted into the center hole of the sintered electrode main body is within the range of 0.9 $mm^2$ to 3.2 $mm^2$.

5. A short arc type high voltage electrical discharge tube, comprising:

a tube body;

a pair of electrical discharge electrodes enclosed in the tube body with a predetermined space between the electrodes;

each of the electrical discharge electrodes including an electrode center spindle made of a body of a refractory metal and having a tip, and electrode main body disposed at the tip of the electrode center spindle, the electrode main body being made of a body of a refractory metal;

wherein a contact area between the electrode main body and the electrode center spindle is within a range of from 0.9 mm2 to 3.2 mm2, for each of the electrical discharge electrodes the electrode center spindle is subjected to a first sintering process to generate a sintered electrode center spindle, the electrode main body is subjected to a second sintering process to generate a sintered electrode main body, and the sintered electrode center spindle is inserted into a center hole of the sintered electrode main body so as to form a combination which is subjected to a third sintering process, a shrinkage ratio of the sintered electrode center spindle is smaller than a shrinkage ratio of the sintered electrode main body, the sintered electrode center spindle has a void content of 5% or less, the combination comprises a plurality of radiator fins, and the contact area of the sintered electrode center spindle and the sintered electrode main body in the state in which the sintered electrode center spindle is inserted into the center hole of the sintered electrode main body is within the range of 0.9 $mm^2$ to 3.2 $mm^2$.

6. The short arc type high voltage electrical discharge tube according to claim 5, wherein:

a diameter of the electrode center spindle is within a range of from 0.25 mm to 0.5 mm.

7. A short arc type high voltage electrical discharge light source apparatus, comprising:

a short arc type high voltage electrical discharge tube including a pair of electrical discharge electrodes enclosed in a tube body with a predetermined space between the electrodes; and a reflector radiating light emitted from the short arc type high voltage electrical discharge tube in a predetermined direction;

each of the electrical discharge electrodes including an electrode center spindle made from a refractory metal and having a tip, and an electrode main body disposed at the tip of the electrode center spindle, the electrode main body being made from a refractory metal;

for each of the electrical discharge electrodes the electrode center spindle is subjected to a first sintering process to generate a sintered electrode center spindle, the electrode main body is subjected to a second sintering process to generate a sintered electrode main body, and the sintered electrode center spindle is inserted into a center hole of the sintered electrode main body so as to form a combination which is subjected to a third sintering process, a shrinkage ratio of the sintered electrode center spindle is smaller than a shrinkage ratio of the sintered electrode main body, the sintered electrode center spindle has a void content of 5% or less, the combination comprises a plurality of radiator fins, and the contact area of the sintered electrode center spindle and the sintered electrode main body in the state in which the sintered electrode center spindle is inserted into the center hole of the sintered electrode main body is within the range of 0.9 $mm^2$ to 3.2 $mm^2$.

8. A short arc type high voltage electrical discharge light source apparatus, comprising:

a short arc type high voltage electrical discharge tube including a pair of electrical discharge electrodes enclosed in a tube body with a predetermined space between the electrodes; and a reflector radiating light emitted from the short arc type high voltage electrical discharge tube in a predetermined direction;

each of the electrical discharge electrodes including an electrode center spindle made from a body of a refractory metal and having a tip, and an electrode main body disposed at the tip of the electrode center spindle, the electrode main body being made of a body of a refractory metal;

wherein a contact area between the electrode main body and the electrode center spindle is within a range of from 0.9 mm2 to 3.2 mm2, for each of the electrical discharge electrodes the electrode center spindle is subjected to a first sintering process to generate a sintered electrode center spindle, the electrode main body is subjected to a second sintering process to generate a sintered electrode main body, and the sintered electrode center spindle is inserted into a center hole of the sintered electrode main body so as to form a combination which is subjected to a third sintering process, a shrinkage ratio of the sintered electrode center spindle is smaller than a shrinkage ratio of the sintered electrode main body, the sintered electrode center spindle has a void content of 5% or less, the combination comprises a plurality of radiator fins, and the contact area of the sintered electrode center spindle and the sintered electrode main body in the state in which the sintered electrode center spindle is inserted into the center hole of the sintered electrode main body is within the range of 0.9 $mm^2$ to 3.2 $mm^2$.

9. The short arc type high voltage electrical discharge light source apparatus according to claim 8, wherein a diameter of the electrode center spindle is within a range of from 0.25 mm to 0.5 mm.

* * * * *